US011504762B2

(12) United States Patent
Nillies

(10) Patent No.: US 11,504,762 B2
(45) Date of Patent: Nov. 22, 2022

(54) METHOD AND FORMING SYSTEM FOR PRODUCING A DRUM-SHAPED GEAR PART

(71) Applicant: Leifeld Metal Spinning AG, Ahlen (DE)

(72) Inventor: Benedikt Nillies, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 99 days.

(21) Appl. No.: 16/721,537

(22) Filed: Dec. 19, 2019

(65) Prior Publication Data

US 2020/0197999 A1 Jun. 25, 2020

(30) Foreign Application Priority Data

Dec. 20, 2018 (EP) ..... 18214820

(51) Int. Cl.
*B21H 5/02* (2006.01)
*B21D 22/16* (2006.01)

(52) U.S. Cl.
CPC ..... *B21H 5/025* (2013.01); *B21D 22/16* (2013.01)

(58) Field of Classification Search
CPC ..... B21H 5/02; B21H 5/025; B21D 22/16; B21D 53/28; B21K 1/30
See application file for complete search history.

(56) References Cited

U.S. PATENT DOCUMENTS

| | | | | |
|---|---|---|---|---|
| 5,384,949 A * | 1/1995 | Wodrich | ..... | B21D 22/16 192/70.2 |
| 8,230,597 B2 * | 7/2012 | Szuba | ..... | B21D 22/16 29/893 |
| 2018/0178266 A1 * | 6/2018 | Kostermeier | ..... | B21D 17/04 |

FOREIGN PATENT DOCUMENTS

| | | | |
|---|---|---|---|
| CN | 103624197 A | * | 3/2014 |
| CN | 103624197 A | | 3/2014 |
| JP | S57-56131 A | | 4/1982 |
| JP | S62-282735 A | | 12/1987 |
| JP | 2010-284662 A | | 12/2010 |

* cited by examiner

*Primary Examiner* — David P Bryant
*Assistant Examiner* — Christine Bersabal
(74) *Attorney, Agent, or Firm* — Studebaker & Brackett PC

(57) ABSTRACT

The invention relates to a method and a forming system for producing a gear part through a rotational forming. According to the invention provision is made in that in a preforming step a rotationally symmetrical workpiece is set into rotation about its center axis and, at least through axial feeding and passing of at least one forming roller, a stretch-flow forming is carried out, wherein a cylindrical circumferential wall with a defined target wall thickness is shaped which is smaller than a basic wall thickness of the workpiece. Subsequently, in a finish-forming step the preformed workpiece is clamped onto an inner mandrel with external toothing and set into rotation and at least one profiled toothed roller is fed radially, by which the cylindrical circumferential wall, whilst substantially maintaining the target wall thickness, is formed into the external toothing of the inner mandrel, wherein a drum-shaped toothed region with a splined toothing is shaped.

7 Claims, 9 Drawing Sheets

METHOD AND FORMING SYSTEM FOR PRODUCING A DRUM-SHAPED GEAR PART

Figure 3:
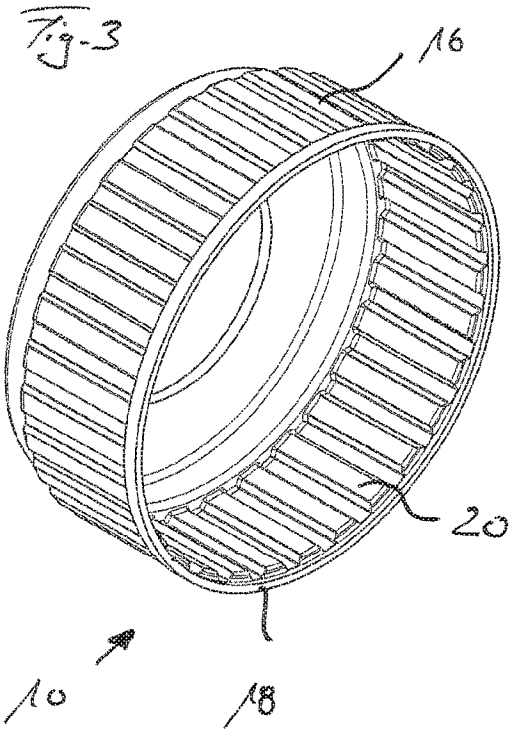

The invention relates to a method for producing a drum-shaped gear part through a rotational forming.

The invention further relates to a forming system, which is in particular designed for carrying out a method for producing a drum-shaped gear part.

From prior art several production methods for drum-shaped gear parts, in particular clutch plate carriers, are known. Depending on the type of utilizable toothing, the number of pieces and the size of the clutch plate carriers, axial rolling on a press is substantially provided in the case of a large number of pieces. In the case of a smaller number of pieces use is made of incremental forming methods, in particular flow forming, profiling or axial rolling in partial steps, according to the torques to be transmitted or the component requirements.

The demands for NOx-reduction and for $CO_2$-saving in vehicle manufacturing require an increasing weight reduction even in gear transmissions and gear components, and thus also with clutch plate carriers. Here, the material requirements furthermore change towards higher-strength materials.

However, ever increasing requirements of the finished part take the currently existing processing methods to their limits and normally call for additional forming steps or post-processing steps.

For the production of clutch plate carriers the so-called splined toothing process has been known for a long time. In this method a cup-shaped deep-drawn part is normally placed onto a profiling machine between a tool mandrel and a pressure disk and is set into rotation. The tool mandrel possesses the negative shape of the component toothing to be produced. A toothed roller with a corresponding toothed profile is then fed to the workpiece so that in the workpiece between the tool mandrel and the toothed roller the toothed profile is formed on the internal side and the external side, whereby a fold-like toothing is developed.

The invention is based on the object to provide a method and a forming system, with which gear parts having a particularly flexible and requirement-oriented component design can be produced efficiently.

According to the invention the object is achieved on the one hand by a method having the features of claim 1 and on the other hand by a forming system having the features of claim 9. Preferred embodiments of the invention are stated in the respective dependent claims.

The method according to the invention is characterized in that in a preforming step a rotationally symmetrical workpiece is set into rotation about its center axis and, at least through axial feeding and passing of at least one forming roller, a stretch-flow forming is carried out, wherein a cylindrical circumferential wall with a defined target wall thickness is shaped which is smaller than a basic wall thickness of the workpiece, and in that subsequently in a finish-forming step the preformed workpiece is clamped onto an inner mandrel with external toothing and set into rotation and at least one profiled toothed roller is fed radially, by which the cylindrical circumferential wall, whilst substantially maintaining the target wall thickness, is formed into the external toothing of the inner mandrel, wherein a drum-shaped toothed region with a splined toothing is shaped.

A basic idea of the invention resides in the fact that as basic part a sheet metal workpiece having a uniform basic wall thickness is used. In a preforming step, for a first weight optimization, a wall thickness reduction in a cylindrical circumferential wall section is carried out, with a defined target wall thickness being set through flow-forming. At the same time, the workpiece is lengthened axially in a desired way. In a partial region of the workpiece, in particular in a radially running hub region, the basic wall thickness of the workpiece can be maintained.

In a subsequent finish-forming step the workpiece can be reclamped and a splined toothing can be formed into the cylindrical circumferential wall region provided with a defined target wall thickness. For this purpose, the workpiece is clamped onto a correspondingly profiled inner mandrel and at least one toothed roller having a correspondent toothed profile is fed radially from the outside, whereby the circumferential wall is formed in a fold-like manner. By splined toothing a toothing is to be understood, in which the toothing is shaped both on the internal side and on the external side, wherein the previously set target wall thickness stays almost the same in the course of the fold-like forming of the cylindrical external circumferential wall.

Within the meaning of the invention the term toothing is to be understood in a broad sense and is in particular not limited to a meshing gear toothing. In fact, within the meaning of the invention the term toothing also includes other tooth-like shapes, such as groove or taper groove profiles, which can be provided e.g. in clutch plate carriers as radial stop elements for the torque transmission.

Generally, as basic workpiece a plane sheet metal part or a deep-drawn part, a forged or a cast part can be used. According to a further development of the invention it is especially advantageous that as basic workpiece a circular blank or a cup-shaped preform is used, in which a hub region is preformed. The hub region runs substantially transversely or radially to the cylindrical circumferential wall. The hub region can be provided with recesses and/or formations as well as with a sleeve-shaped hub.

According to another advantageous embodiment variant of the invention it is preferred that the preforming step and/or the finish-forming step are carried out in several partial steps in the same workpiece clamping. For instance, the preforming step can initially reside in an approximately rectangular folding-over of an external region of a plane circular sheet metal blank and in a subsequent flow-forming or stretch-flow forming, in which the basic wall thickness of the sheet metal part is reduced to the desired target wall thickness.

Likewise, in the finish-forming step provision can also be made for several partial steps that are in each case carried out by radially feeding different toothed rollers in several stages.

By way of such forming in several partial steps or stages overstrain of the workpiece material and thus the appearance of cracks in the material can be prevented.

According to a further method variant of the invention it is preferred that during the forming of the splined toothing the workpiece is held axially and/or radially in its edge region at the open end lying opposite a radially running hub region. Through the holding at the open edge of the workpiece undesired expansions of the workpiece diameter in the edge region are prevented. All in all, the quality of the splined toothing is also enhanced thereby.

In this connection it is especially preferred that an axial holding takes place in a flexible manner, in particular in a pressure-dependent manner, wherein length or volume tolerances of the workpiece are compensated. Hence, according to this variant of the invention it is not a rigid holding that is provided but a holding which can be released or at least partially released e.g. when a predetermined limit pressure or a limit force is exceeded. For this the holding means can be provided with a suitable spring means or hydraulic damping elements. This allows dimensional or material tolerances on the workpiece to be compensated to a certain extent so that excess material develops in the edge region while the splined toothing can be shaped with a high degree of precision. However, provision can also be made for a rigid holding of the open end if the tolerances in the basic material are small.

Basically, the at least one toothed roller is fed to the workpiece in a single radial feed movement. The toothed roller can have an axial length that corresponds to the axial length of the splined toothing to be introduced. A preferred method variant can reside in the fact that during radial feeding or during the forming process the at least one toothed roller is displaced axially or fed radially in at least two steps which are carried out in positions that are axially offset to each other. Thus, a relatively long splined toothing can also be produced with a toothed roller of shorter length. In this way, greater flexibility in the forming process can be achieved.

For good reinforcement of the open edge of the workpiece it is advantageous in accordance with a further preferred embodiment variant of the invention that in the edge region of the workpiece a reinforced region preferably of greater wall thickness is designed. As early as in the preforming step comprising flow-forming or stretch-flow forming the reinforced region of great wall thickness can be set in that the forming roller stops before the end of the edge region. In this, the material reinforcement can be the basic wall thickness of the workpiece. Alternatively, an additional material thickening can also be produced in the edge region by the material shifted during stretch-flow forming.

A forming system according to the invention, which is in particular designed for carrying out one of the previously described methods, comprises at least a first forming station which has a rotationally drivable main spindle, at least one forming roller that can be fed relatively axially and a first clamping element which is designed for clamping a workpiece on the main spindle, at least a second forming station which has a rotationally drivable inner mandrel with an external toothing, at least one toothed roller that can be fed radially and a second clamping element which is designed for clamping the workpiece on the inner mandrel, and a handling station which is arranged between the first forming station and the second forming station and designed for transferring the workpiece after a preforming in the first forming station to the second forming station for finish-forming. The first and second forming station can be identical in that the workpiece is produced in two set-ups in one station.

By way of the forming system according to the invention the advantages described beforehand in conjunction with the method can be attained. The forming stations can be arranged on a joint machine bed. The handling station preferably is a multi-axial robot which transfers and delivers or removes the workpieces between the forming stations.

A preferred embodiment of the forming system according to the invention resides in the fact that the first forming station is designed for spinning and flow forming and in that the second forming station is designed for profiling. The forming stations can have horizontal or preferably vertical axes of rotation.

According to a further development of the invention it is especially advantageous that the main spindle of the first forming station and the inner mandrel of the second forming station are directed in parallel and vertically. Through this an overall compact forming system with a small supporting surface can be created.

Furthermore, in accordance with a further development of the invention it is advantageous for an efficient method process that for clamping the workpiece on the first forming station a first tailstock spindle is assigned to the main spindle and in the second forming station a second tailstock spindle is assigned to the inner mandrel, wherein the first tailstock spindle and the second tailstock spindle are supported in an axially displaceable manner. The tailstock spindles are arranged coaxially to the axis of rotation of the main spindle and the inner mandrel respectively. An axial displacement is in particular achieved by suitable lifting cylinders that are preferably actuated hydraulically.

Moreover, for a quick changeover it is particularly expedient that the main spindle, the inner mandrel, the first tailstock spindle and/or the second tailstock spindle are supported by means of a quick-changing means. The quick-changing means allows a rapid exchange of the respective component. This is especially economical with regard to maintenance and in particular in the case of a product change.

Furthermore, according to a further development of the invention it is preferred for the forming or clamping that the handling station is designed for delivering the workpiece to be formed and for removing the finish-formed workpiece. Thus, the handling station not only serves purely as a transfer station between the individual forming stations but also serves the overall purpose of delivering and/or removing the workpieces to or from the system. For this, the handling station can in particular have at least one multi-axial robot with a corresponding gripping means for gripping the workpiece.

According to an embodiment variant of the forming system pursuant to the invention a particularly good shaping is achieved in that by way of a synchronization transmission or a drive controlled in a rotationally synchronous manner the at least one toothed roller is driven in a rotation angle synchronous manner to the inner mandrel. This ensures that the toothing of the toothed roller is always arranged in a corresponding and synchronous manner to the external toothing on the inner mandrel. The toothed roller and the inner mandrel can be driven by a joint drive with a corresponding synchronization transmission. Alternatively, the at least one toothed roller and the inner mandrel can each have a drive of their own, in which case the drives are driven in a rotation angle synchronous manner by an electronic control.

Figure 2:
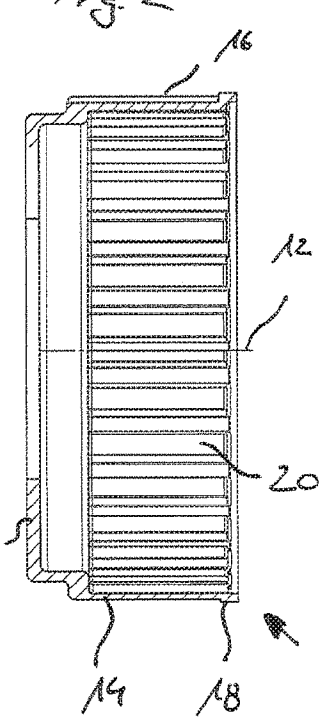
Figure 1:
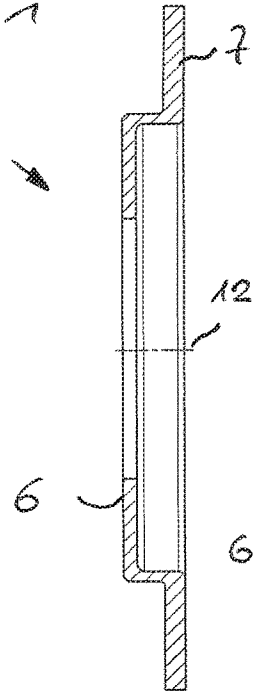
Figure 4:
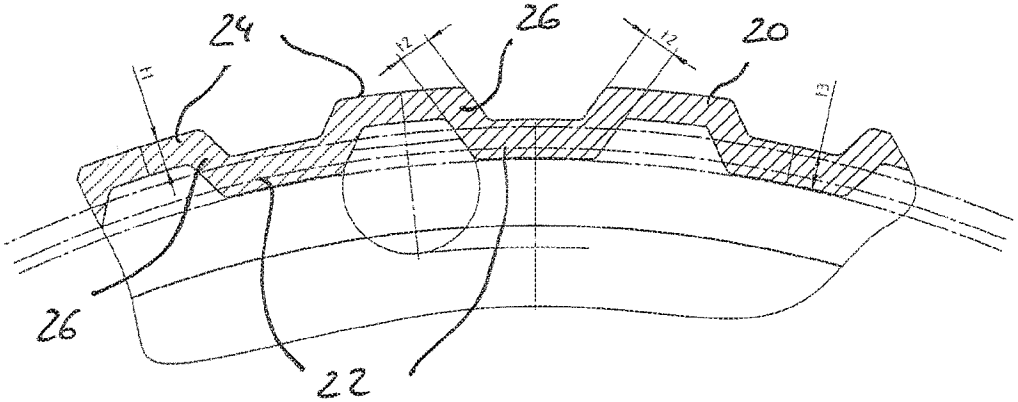
Figure 5:
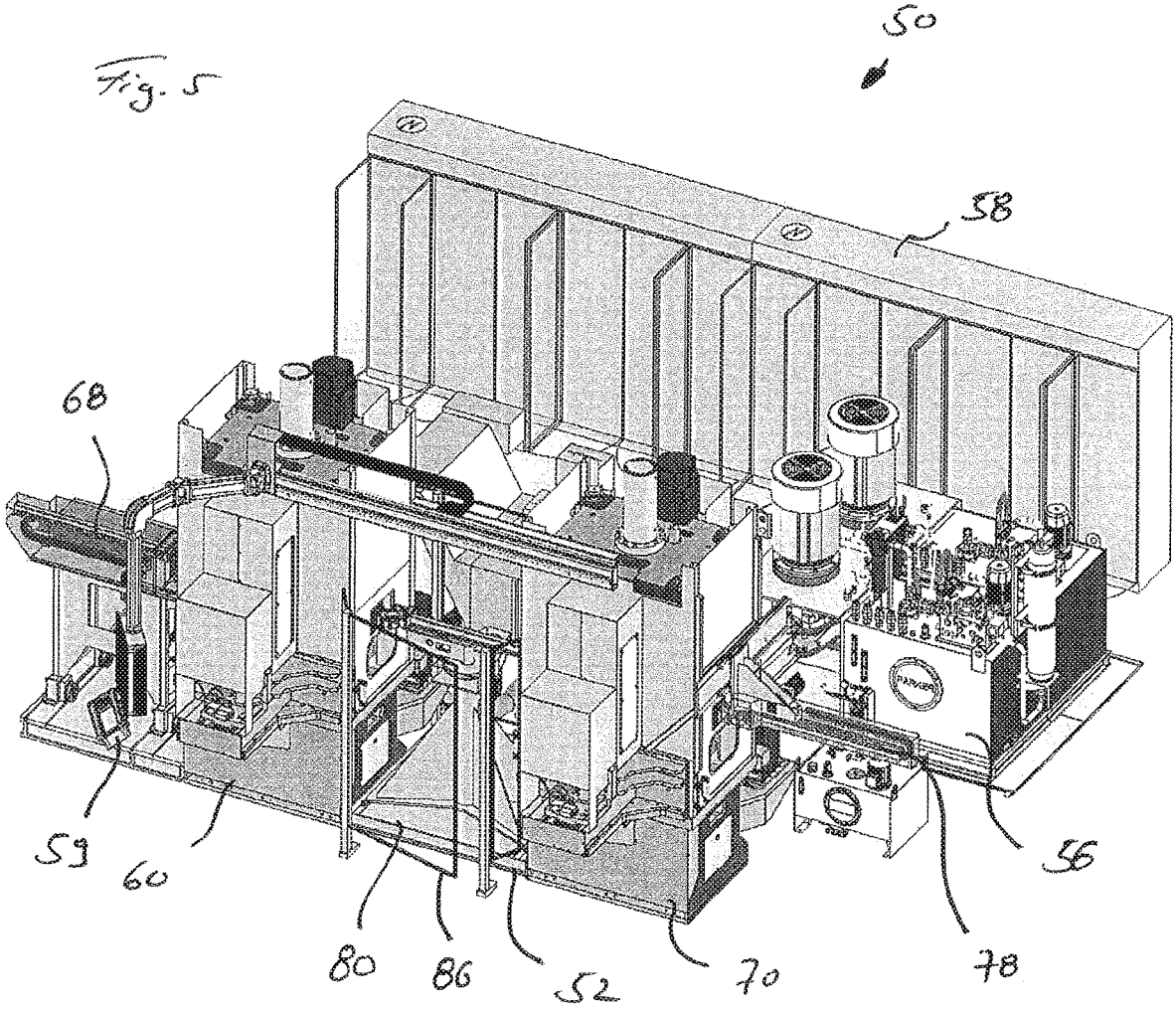
Figure 6:
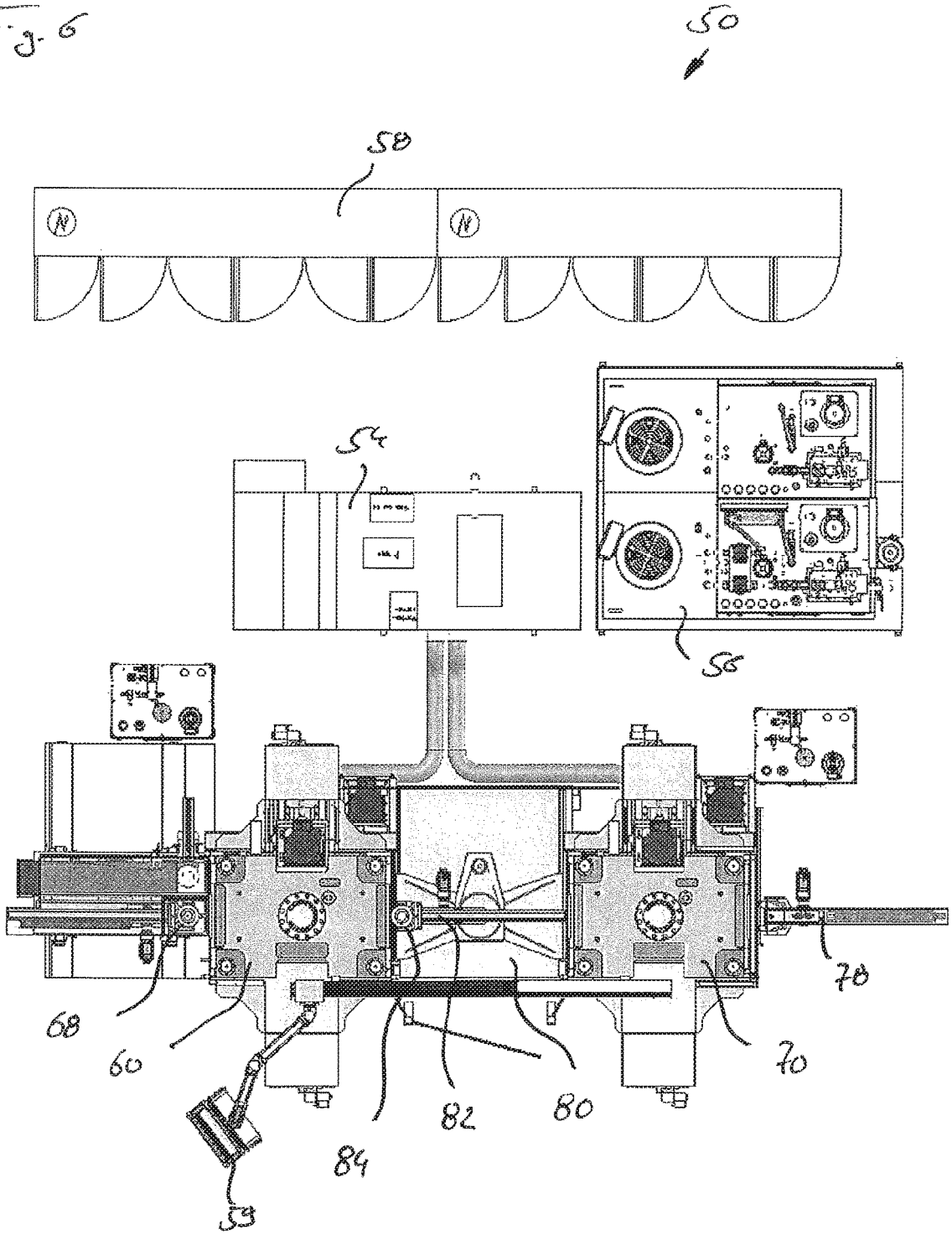
Figure 7:
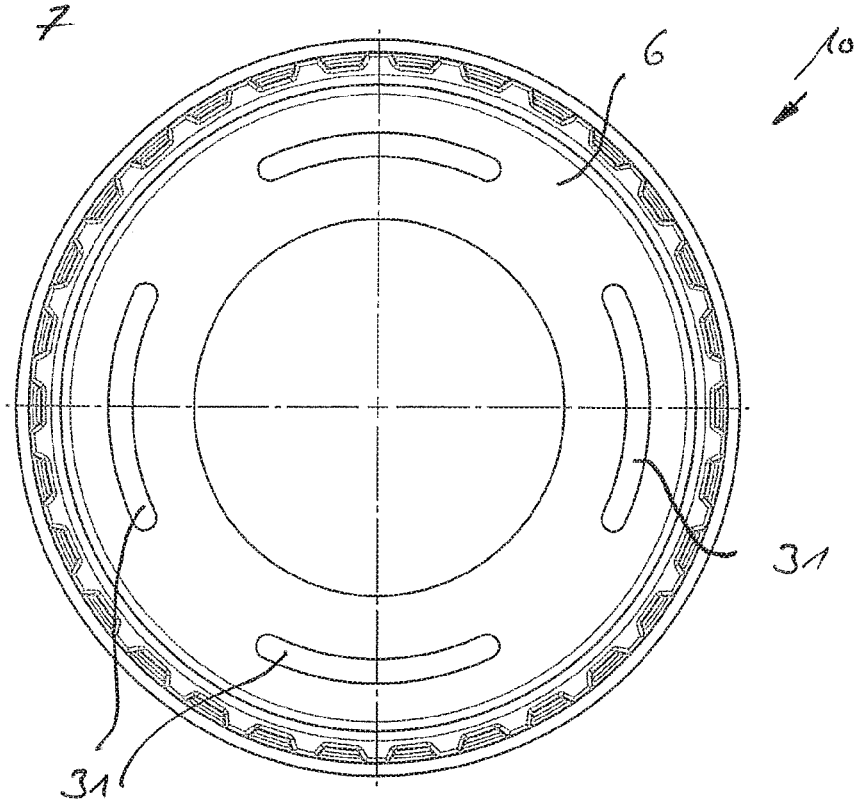
Figure 8:
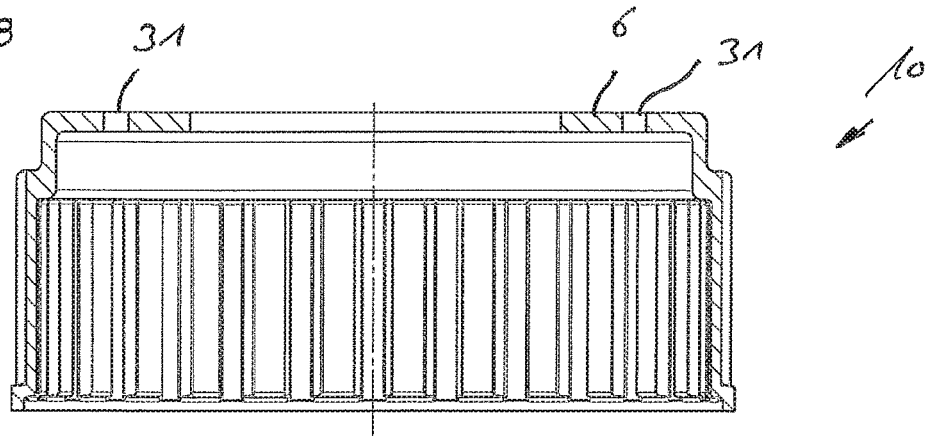
Figure 9:
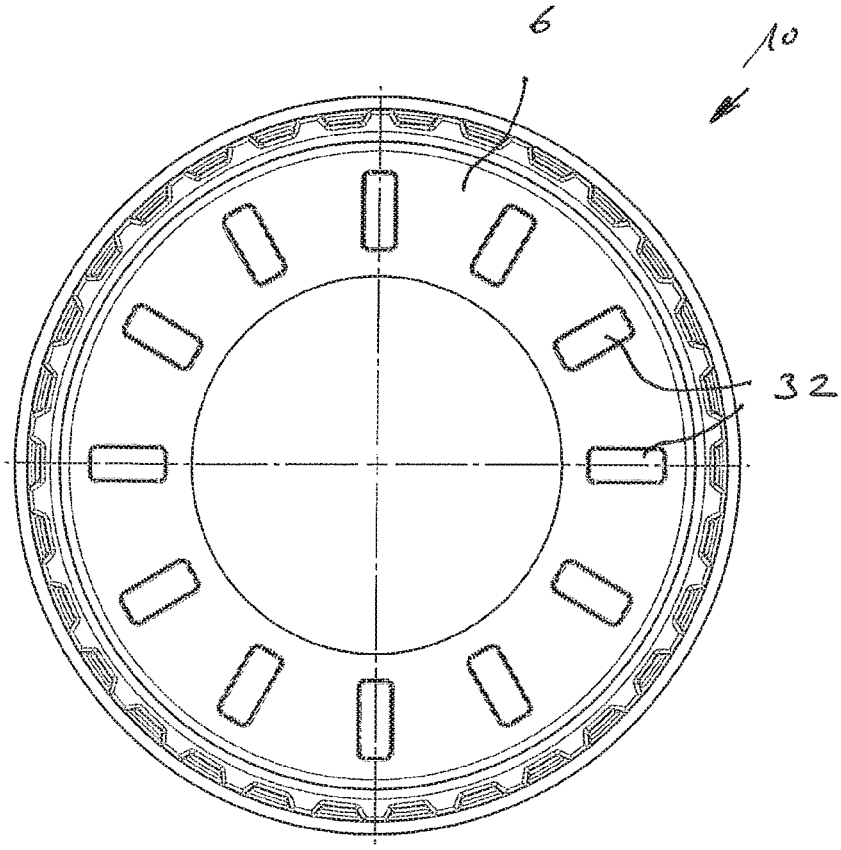
Figure 10:
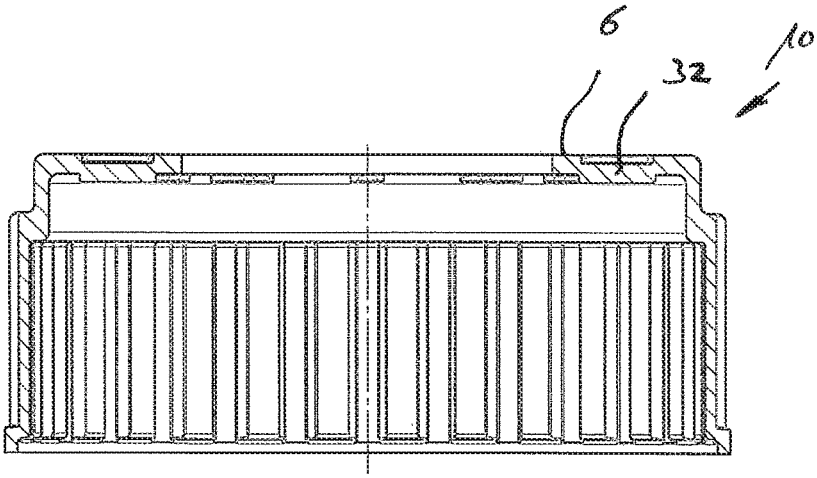
Figure 11:
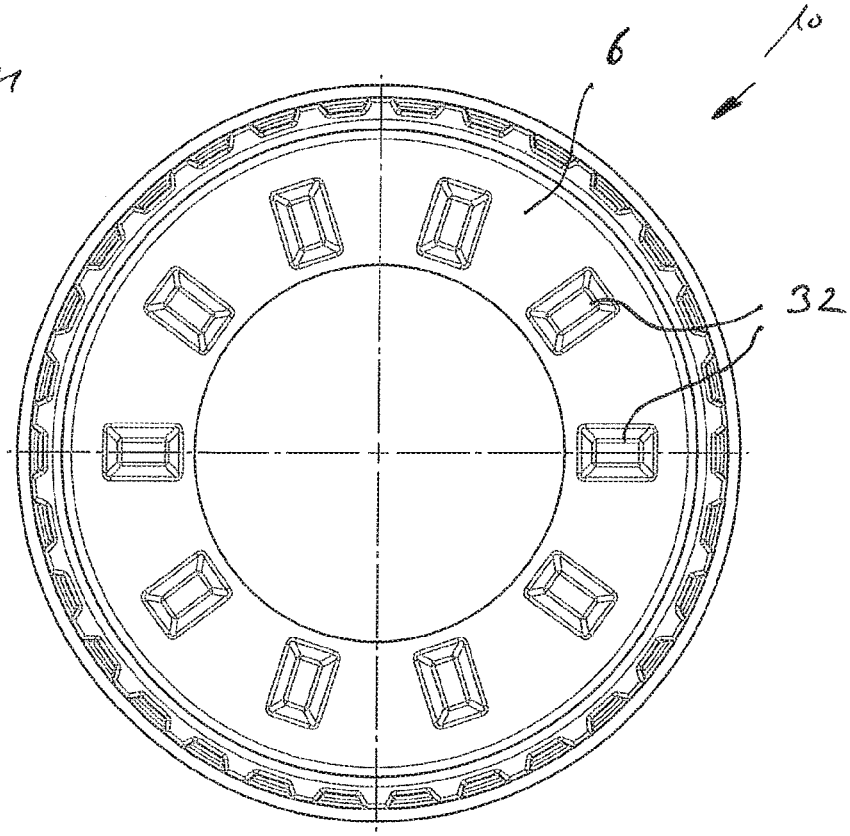
Figure 12:
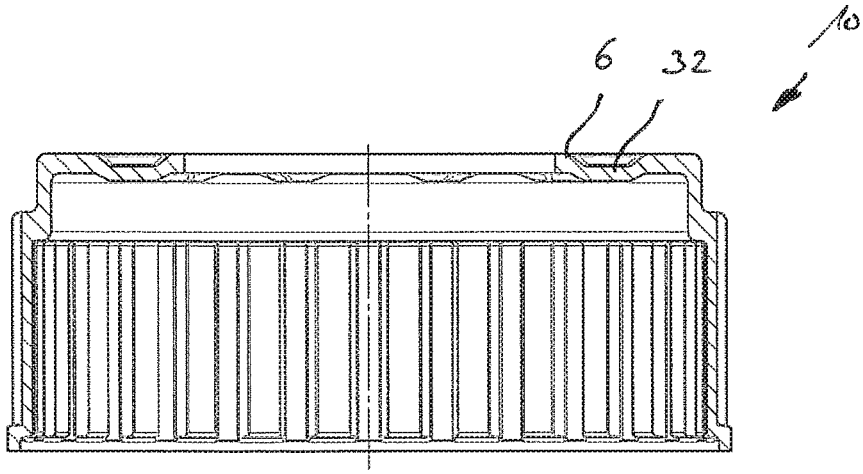
Figure 13:
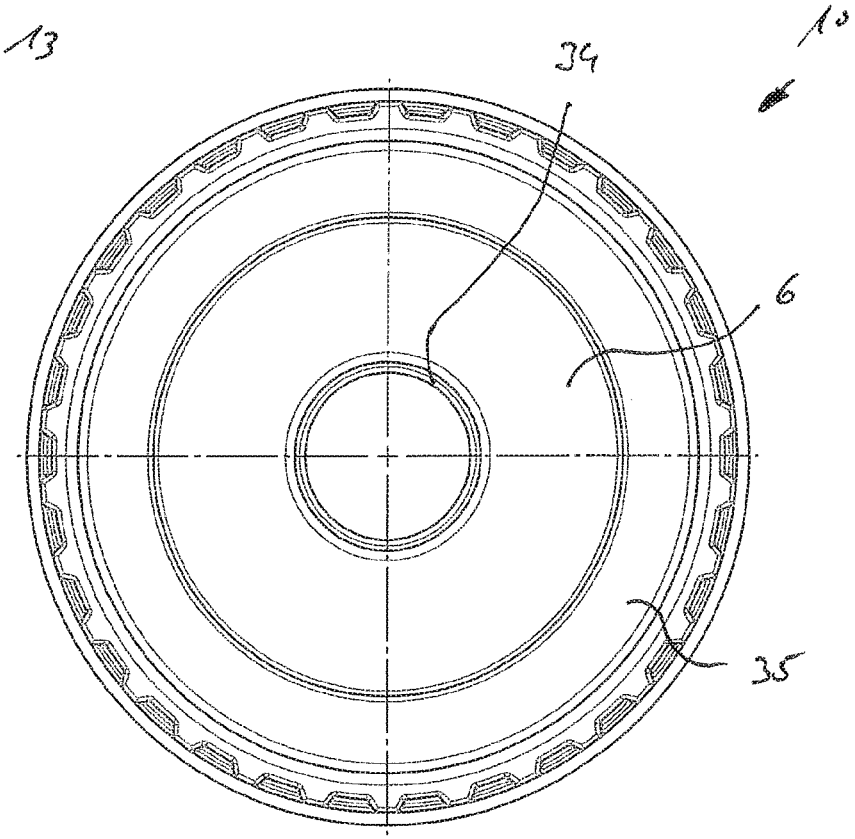
Figure 14:
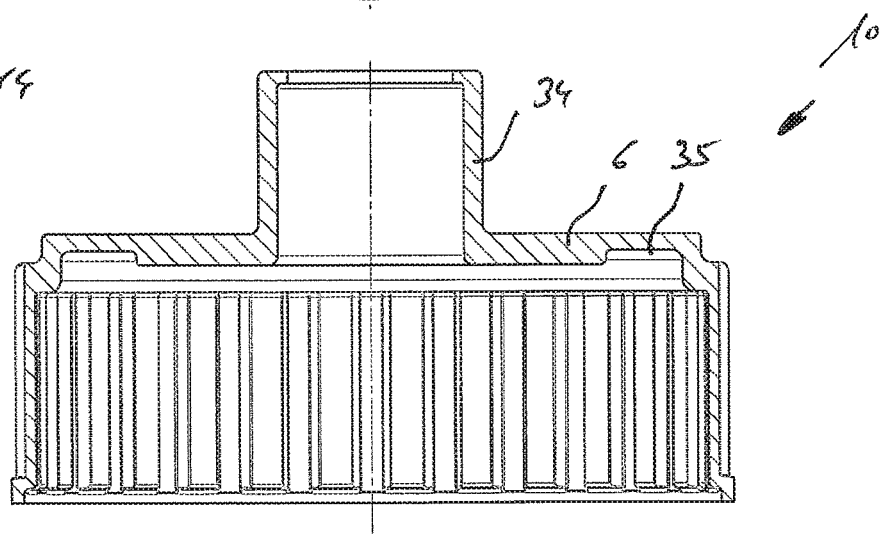
Figure 15:
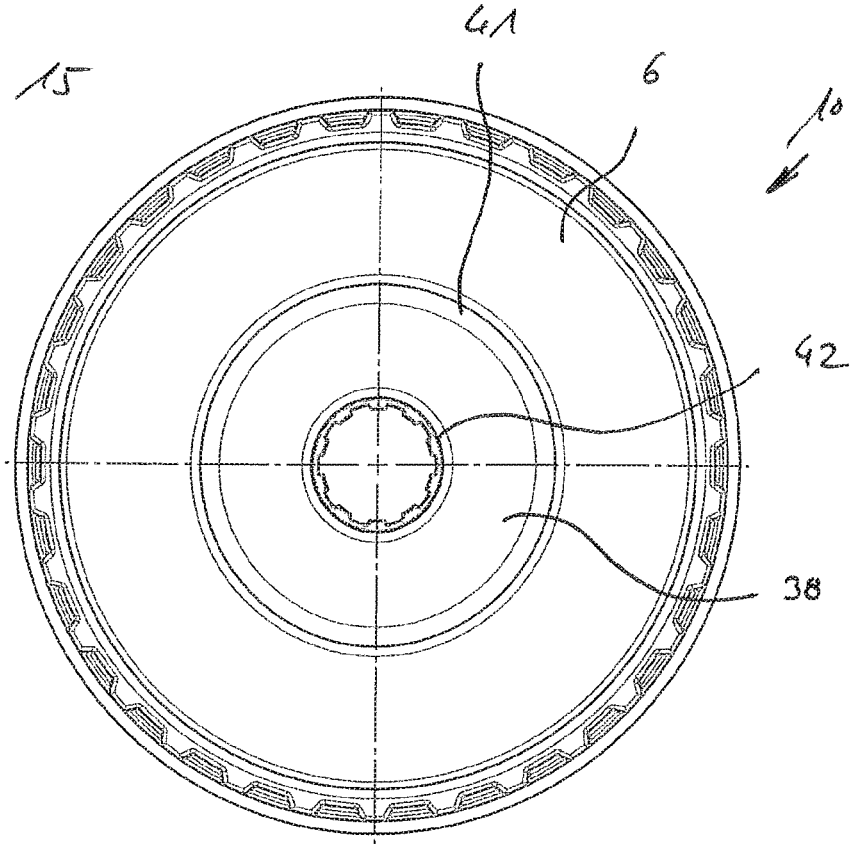
Figure 16:
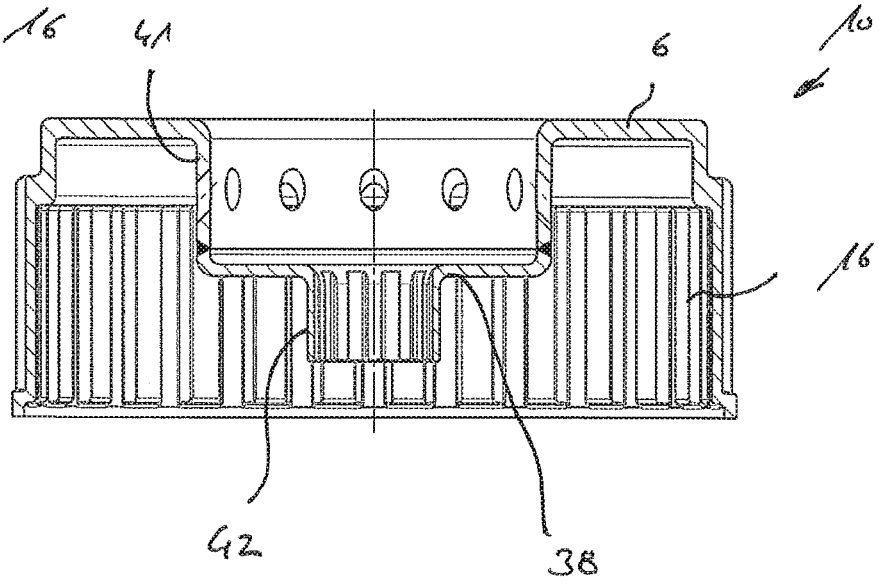
Figure 16:
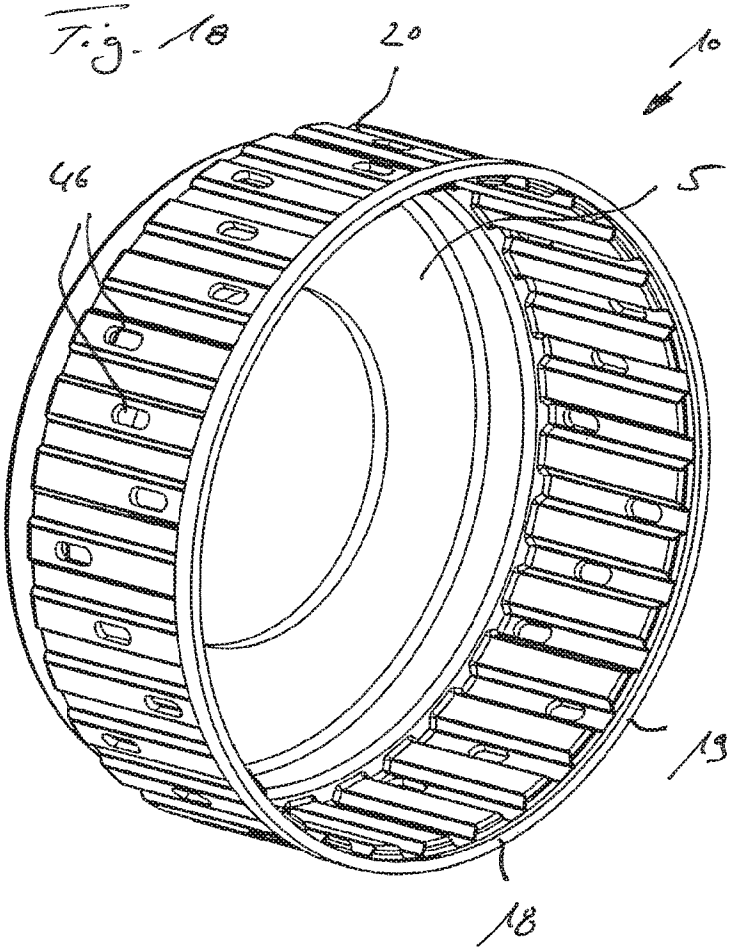
Figure 17:
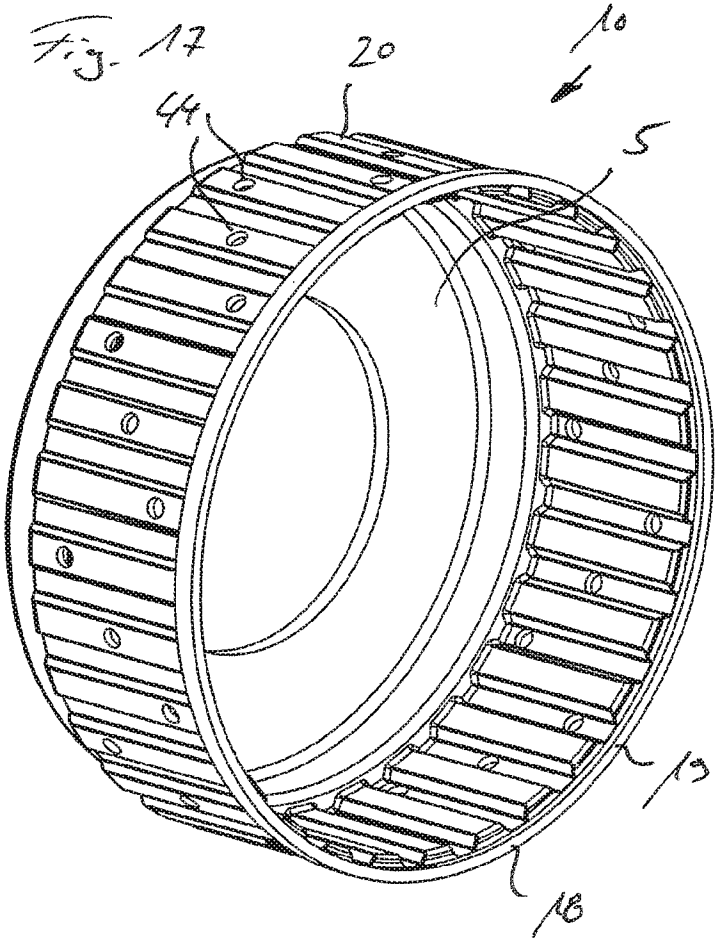

The invention is explained further hereinafter by way of preferred embodiments illustrated schematically in the drawings, wherein show:

FIG. 1 a cross-sectional view of a rotationally symmetrical basic workpiece;

FIG. 2 a cross-sectional view of a drum-shaped gear part produced according to the invention;

FIG. 3 a perspective view of the gear part of FIG. 2;

FIG. 4 an enlarged detailed cross-sectional view of a splined toothing on the workpiece according to FIGS. 2 and 3;

FIG. 5 a perspective view of a forming system according to the invention;

FIG. 6 a top view of the forming system of FIG. 5;

FIG. 7 a front view of a second embodiment of a gear part produced according to the invention;

FIG. 8 a cross-sectional view of the gear part of FIG. 7;

FIG. 9 a front view of a third embodiment of a gear part produced according to the invention;

FIG. 10 a cross-sectional view of the gear part of FIG. 9;

FIG. 11 a front view of a fourth embodiment of a gear part produced according to the invention;

FIG. 12 a cross-sectional view of the gear part of FIG. 11;

FIG. 13 a front view of a fifth embodiment of a gear part produced according to the invention;

FIG. 14 a cross-sectional view of the gear part of FIG. 13;

FIG. 15 a front view of a sixth embodiment of a gear part produced according to the invention;

FIG. 16 a cross-sectional view of the gear part of FIG. 15;

FIG. 17 a perspective view of a further embodiment variant of a gear part produced according to the invention with circular recesses in the splined toothing; and FIG. 18 a perspective view of a further embodiment variant of a gear part produced according to the invention with elongated holes in the splined toothing.

In FIG. 1 a basic workpiece 5 in the shape of a circular blank or plate, also referred to as workpiece 5, is illustrated. This has a radially running hub region 6 with a central recess. Arranged in a stepped manner with respect to the hub region 6 is a thickened circumferential region 7. The workpiece 5 can be produced by deep-drawing, forging, casting or in another suitable way.

In a non-depicted preforming step the workpiece 5 is clamped on a rotationally drivable main spindle and folded over axially by approximately 90° by means of at least one forming roller capable of being fed axially, wherein by way of a generally known stretch-flow forming process a basic wall thickness of the workpiece 5 is at the same time shaped to a defined target wall thickness of the desired cylindrical circumferential wall 14.

In a subsequent finish-forming step the workpiece 5 thus preformed is then finish-formed to a drum-shaped gear part 10 which is illustrated in FIGS. 2 and 3. In this finish-firming step a splined toothing 20 is formed into a toothed region 16 while the target wall thickness of the cylindrical circumferential wall 14 is substantially maintained. At an open end lying axially opposite the hub region 6 that did not undergo further forming the splined toothing 20 is bounded by an annular edge region 18.

The splined toothing 20 designed on the gear part 10 according to the invention is shown in FIG. 4. To shape the splined toothing 20 the workpiece 5 is clamped with the cylindrical circumferential wall 14 onto an inner mandrel with a corresponding external toothing and set into rotation. Afterwards, at least one profiled toothed roller is fed radially, by which the cylindrical circumferential wall 14 is formed or folded into the external toothing of the inner mandrel while the target wall thickness is substantially maintained. In doing so, recessed regions 22 and protruding regions 24 are developed that are connected to each other via obliquely directed flanks 26 in the illustrated embodiment. The protruding regions 24 can have a wall thickness t1, the flanks 26 a wall thickness t2 and the recessed regions 22 a wall thickness t3, which differ slightly from each other, in particular by a few tenths of a millimeter, while, within the meaning of the invention, the previously set target wall thickness is substantially maintained.

Thus, by way of the invention a weight-optimized gear part 10 can be produced, in which, as compared to a hub region 6 having a substantially unchanged wall thickness, a reduced wall thickness is set in a non-cutting manner on a cylindrical circumferential wall 14, into which the desired splined toothing 20 is then introduced.

A forming system 50 according to the invention is shown schematically in FIGS. 5 and 6. On a machine bed 52, preferably of multi-part design, a first forming station 60 and a second forming station 70 are arranged. Between the first forming station 60 and the second forming station 70 a handling station 80 with a multi-axial robot 82 is provided that has a gripping means 84 for gripping a workpiece and for transferring the workpiece from the first forming station 60 to the second forming station 70.

According to a generally known flow-forming machine the first forming station 60 is designed with a rotationally drivable main spindle that is provided for a vertical arrangement in the illustrated embodiment. Via a lateral delivery means 68, which can also be a multi-axial robot with gripping means, a basic workpiece is delivered laterally into the first forming station 60. By way of a first tailstock spindle the delivered basic workpiece is clamped axially on the main spindle with a forming mandrel that is cylindrical at least in some regions. Afterwards, the main spindle, together with the first tailstock spindle, is set into rotation and at least one forming roller is fed to the workpiece. The forming roller passes axially over a circumferential region of the basic workpiece so that a cylindrical circumferential wall with a defined, reduced wall thickness, also referred to as target wall thickness, is produced. The target wall thickness complies with the necessary strength conditions required for the splined toothing 20 to be formed in.

After this first preforming step in the first forming station 60 the clamping of the workpiece is released again and by means of the multi-axial robot 82 the workpiece is taken out of the first forming station 60 and transferred to the second forming station 70. In the second forming station 70 the preformed workpiece is clamped axially by means of a second tailstock spindle on an inner mandrel having an external toothing. A center axis of the workpiece and an axis of rotation of the inner mandrel are also directed vertically.

After clamping of the preformed workpiece this is set into rotation by the inner mandrel and at least one profiled toothed roller is then fed radially to the cylindrical circumferential wall of the workpiece. The profile of the toothed roller matches the profile of the external toothing on the inner mandrel in such a manner that the cylindrical circumferential wall is formed or, as it were, folded into the recesses of the external toothing of the inner mandrel. In doing so, the previously set target wall thickness remains largely unchanged.

On completion of the finish-forming step the ready-formed gear part 10 is removed laterally by a removal means 78 which can also have a multi-axial robot with a gripping means.

For the various drives, which are hydraulic or electric drives in particular, the forming system 50 according to the invention has a cooling and lubricating means 54 for cooling the hydraulic fluid and a hydraulic station 56. Furthermore, a control means 58 is provided which is arranged in the form of control cabinets.

By preference, the handling station 80 is provided with a door 86 so that the handling station is accessible for operating and maintenance purposes. Furthermore, on a front side of the forming station 50 an operating unit 59 with a monitor and an input terminal is preferably arranged.

In FIGS. 7 and 8 a second embodiment of a gear part 10 produced in accordance with the invention is illustrated, in which case in the hub region 6 elongated holes 31 running in the circumferential direction are introduced together with a central opening.

In the third embodiment of a gear part 10 produced in accordance with the invention and pursuant to FIGS. 9 and 10 impressions 32 are formed into the hub region. These can be designed in a radially directed manner and serve as an additional reinforcement of the hub region 6. The impressions 32 can be formed in before the preforming step or during clamping in the first forming station 60 by a correspondingly designed and shaped main spindle.

The fourth embodiment of a gear part 10 according to the invention and pursuant to FIGS. 11 and 12 also shows impressions 32 that are formed into the hub region 6 and shaped more distinctively as compared to the third embodiment.

In the fifth embodiment of a gear part 10 produced according to the invention and pursuant to FIGS. 13 and 14 a sleeve-shaped hub 34 is arranged in the hub region 6. The sleeve-shaped hub 34 can be designed on the basic workpiece by deep-drawing, casting or forging or in another way. Furthermore, for an additional weight optimization in the hub region 6 an annular formation 35 providing a further optimization in terms of weight and constructed space can be designed.

In the sixth embodiment pursuant to FIGS. 15 and 16 a connecting hub 38 directed inwards to the toothed region 16 is designed in the gear part 10 according to the invention. This can have a first section 41 of larger diameter and a second section 42 of smaller diameter that are connected to each other by a stepped region. In the cylindrical wall of the first section 41 cross bores or cross openings can be provided. On the internal side of the cylindrical second section 42 grooves can be designed that are configured to create a shaft-hub connection.

The connecting hub 38 with the first section 41 and the second section 42 can be shaped integrally with the basic workpiece e.g. by deep drawing or can alternatively be produced of two parts by welding, as illustrated in FIG. 16.

In addition to the specific design of the hub region 6 embodiment variants also reside in an alternative design of the splined toothing 20, as depicted in FIGS. 17 and 18. For instance in the splined toothing 20 according to the embodiment of FIG. 17 cross bores 44 are introduced which serve for the passage of transmission oil when used as clutch plate carrier.

Similarly, according to the embodiment pursuant to FIG. 18 axial elongated holes 46 can be introduced into the splined toothing 20. At the end of the splined toothing 20 facing away from the hub region 6 an edge region 18 with a material thickening can be designed for creating an annular reinforced region 19.

The embodiment variants of a gear part 10 produced in accordance with the invention and illustrated in FIGS. 7 to 18 can be combined with each other in any desired way in their design variants.

The invention claimed is:

1. A method for producing a drum-shaped gear part through a rotational forming, wherein in a preforming step a rotationally symmetrical workpiece is set into rotation about its center axis and, at least through axial feeding and passing of at least one forming roller, a stretch-flow forming is carried out, wherein a cylindrical circumferential wall with a defined target wall thickness is shaped which is smaller than a basic wall thickness of the workpiece, subsequently in a finish-forming step the preformed workpiece is clamped onto an inner mandrel with external toothing and set into rotation and at least one profiled toothed roller is fed radially, by which the cylindrical circumferential wall, whilst maintaining the target wall thickness, is formed by the external toothing of the inner mandrel such that a drum-shaped toothed region with a splined toothing is formed, and during the forming of the splined toothing the workpiece is held axially and/or radially in an edge region at the open end lying opposite a radially running hub region to form an annular edge region without any teeth at the open end.

2. The method according to claim 1, wherein as a basic workpiece for the rotationally symmetrical workpiece in the preforming step, a circular blank or a cup-shaped preform is used, in which a hub region is preformed.

3. The method according to claim 1, wherein the preforming step and/or the finish-forming step is carried out in several partial steps in the same workpiece clamping.

4. The method according to claim 1, wherein an axial holding takes place in a pressure-dependent manner, wherein length or volume tolerances of the workpiece are compensated.

5. The method according to claim 1, wherein during radial profiling the at least one toothed roller is displaced axially or fed radially in at least two steps which are carried out in positions that are axially offset to each other.

6. The method according to claim 1, wherein in an edge region of the workpiece a reinforced region of greater material thickness is designed.

7. The method according to claim 1, wherein through forming or turning a hub region is weight- or strength-optimized.

* * * * *